US006153821A

United States Patent [19]

Fay et al.

[11] Patent Number: 6,153,821

[45] Date of Patent: Nov. 28, 2000

[54] SUPPORTING ARBITRARY BEAT PATTERNS IN CHORD-BASED NOTE SEQUENCE GENERATION

[75] Inventors: Todor C. Fay, Bellevue; Robert S. Williams, Seattle; David G. Yackley, Redmond, all of Wash.

[73] Assignee: Microsoft Corporation, Redmond, Wash.

[21] Appl. No.: 09/243,325

[22] Filed: Feb. 2, 1999

[51] Int. Cl.[7] ..... G10H 1/36; G10H 7/00

[52] U.S. Cl. ..... 84/634; 84/637

[58] Field of Search ..... 84/609, 613, 634, 84/637

[56] References Cited

U.S. PATENT DOCUMENTS

| | | | |
|---|---|---|---|
| 4,526,078 | 7/1985 | Chadabe | 84/1.03 |
| 4,716,804 | 1/1988 | Chadabe | 84/1.03 |
| 5,052,267 | 10/1991 | Ino | 84/613 |
| 5,164,531 | 11/1992 | Imaizumi et al. | 84/634 |
| 5,179,241 | 1/1993 | Okuda et al. | 84/613 |
| 5,218,153 | 6/1993 | Minamitaka | 84/613 |
| 5,278,348 | 1/1994 | Eitaki et al. | 84/636 |
| 5,281,754 | 1/1994 | Farrett et al. | 84/609 |
| 5,286,908 | 2/1994 | Jungleib | 81/603 |
| 5,315,057 | 5/1994 | Land et al. | 84/601 |
| 5,355,762 | 10/1994 | Tabata | 84/609 |
| 5,455,378 | 10/1995 | Paulson et al. | 84/610 |
| 5,481,066 | 1/1996 | Kitamura | 84/637 |
| 5,496,962 | 3/1996 | Meier et al. | 84/601 |
| 5,712,436 | 1/1998 | Sakama et al. . | |
| 5,753,843 | 5/1998 | Fay | 84/609 |
| 5,763,804 | 6/1998 | Rigopulos et al. | 84/609 X |
| 5,942,710 | 8/1999 | Hayakawa et al. | 84/637 |

*Primary Examiner*—Jeffrey Donels
*Attorney, Agent, or Firm*—Lee & Hayes, PLLC

[57] ABSTRACT

A performance engine selects note patterns from a pattern style containing a plurality of note patterns. The note patterns are categorized by embellishment type and by ranges of playback levels. In addition, a beat pattern is specified for each note pattern, indicating the chord rhythm with which the style can be used. The beat pattern is a bit array, with bits corresponding to every beat of one or more contiguous measures. In response to selection of a particular embellishment type and playback level, the performance engine selects a note pattern that meets the following qualifications: (a) it is of the selected embellishment type; (b) its designated range of playback levels includes the selected playback level; and (c) its beat pattern indicates that it can accommodate chord changes at the beats at which such changes occur in the currently selected chord progression. If there are no qualifying note patterns, these conditions are gradually relaxed until at least one of the note patterns qualifies.

22 Claims, 6 Drawing Sheets

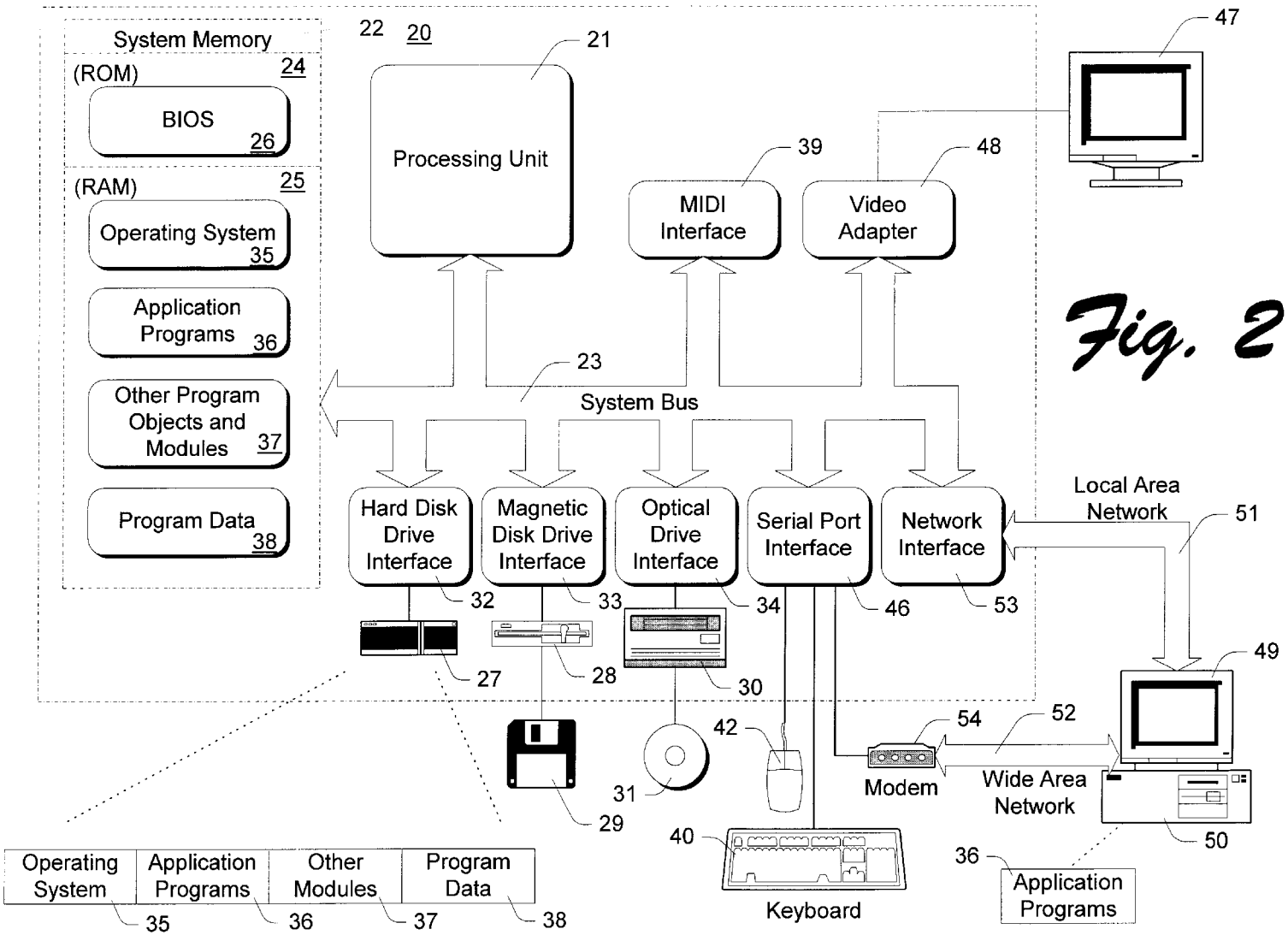
Fig. 2
47
48
Video Adapter
39
MIDI Interface
21
Processing Unit
20
22
23
System Bus
Network Interface
53
Serial Port Interface
46
Optical Drive Interface
34
Magnetic Disk Drive Interface
33
Hard Disk Drive Interface
32
51
Local Area Network
49
50
52
Wide Area Network
54
Modem
Application Programs
36
Keyboard
40
42
30
31
28
29
27
System Memory
24
(ROM)
BIOS
26
25
(RAM)
Operating System
35
Application Programs
36
Other Program Objects and Modules
37
Program Data
38
Operating System
35
Application Programs
36
Other Modules
37
Program Data
38

SUPPORTING ARBITRARY BEAT PATTERNS IN CHORD-BASED NOTE SEQUENCE GENERATION

TECHNICAL FIELD

The present invention relates to computer-based musical performance devices. In particular, the invention relates to methods of selecting note sequences that are to be played against dynamically selected chord progressions.

BACKGROUND OF THE INVENTION

Context-sensitive musical performances have become essential components of electronic and multimedia products such as stand-alone video games, computer based video games, computer based slide show presentations, computer animation, and other similar products and applications. As a result, music generating devices and/or music playback devices have been more highly integrated into electronic and multimedia products. Previously, musical accompaniment for multimedia products was provided in the form of pre-recorded music that could be retrieved and performed under various circumstances.

Using pre-recorded music for providing context-sensitive musical performances has several disadvantages. One disadvantage is that the pre-recorded music requires a substantial amount of memory storage. Another disadvantage is that the variety of music that can be provided using this approach is limited by the amount of available memory. The musical accompaniment for multimedia devices utilizing this approach is wasteful of memory resources and can be very repetitious.

Today, music generating devices are directly integrated into electronic and multimedia products for composing and providing context-sensitive, musical performances. These musical performances can be dynamically generated in response to various input parameters, real-time events, and conditions. For instance, in a graphically based adventure game, the background music can change from a happy, upbeat sound to a dark, eerie sound in response to a user entering into a cave, a basement, or some other generally mystical area. Thus, a user can experience the sensation of live musical accompaniment as he engages in a multimedia experience.

One way of accomplishing this is to define musical performances as combinations of chord progressions and note sequences, so that notes are calculated during a performance as a function of both a chord progression and a note sequence.

A chord progression defines a time sequence of chords. An individual chord is defined as a plurality of notes, relative to an absolute music scale.

A note sequence defines a time sequence of individual notes. The notes of a note sequence, however, are not defined in terms of the absolute music scale. Rather, the notes are defined by their positions within underlying chords. As a simple example, a note might be defined as the second note of a chord. This note would then vary depending on the particular chord with which the note was played. The second note of a C chord is E, so an E is played when the note is interpreted in conjunction with a C chord. The second note of a G chord is B, so a B is played when the note is interpreted in conjunction with a G chord. Interpreting a chord in this manner is referred to as playing the note "against" a specified chord. The result of this is that the notes of a musical track are transposed or mapped to different pitches when played against different chords.

To generate actual output notes based on a chord progression and a note sequence, the notes of the note sequence are played against the chords of the chord progression. The chords of the progression have associated timing, so that any given note from the note sequence is matched with a particular chord of the progression. When the note is played, it is played against a corresponding chord of the progression. This scheme allows a musical performance to be varied in subtle ways, by changing either the chord progression or the note sequence as the performance progresses.

Prior art music generation systems enhanced this scheme by grouping note sequences into so-called "styles," also referred to herein as "sequence styles." A sequence style was a set of related note sequences, also referred to herein as patterns or note patterns, that provided similar sounds. Typically, a style had one or more patterns corresponding to different embellishments such as intros, primary repeating themes, and endings. A style also included patterns having different intensity levels (often referred to as "groove" levels), used to portray the same basic music theme at different levels of intensity. Generally, intensity relates to number of notes played per unit of time—the greater the number of notes played, the greater the intensity. Within a sequence style, the patterns were organized by the type of embellishments they represented and by their intensity levels. In other words, a particular pattern was selected by specifying the type of embellishment and the intensity level at which the embellishment was to be rendered. Each pattern was assigned a discrete intensity level ranging from "A" to "D." Intensity level "A" was considered to be the least intense pattern within an embellishment category and intensity level D was considered to be the most intense.

As a further enhancement in the prior art, several note patterns were provided for a given embellishment type and intensity level, each designed to support a particular rhythm of chord changes. Three discrete flags were used to indicate the rhythm supported by any particular style pattern. One flag indicated that the pattern was designed to allow or accommodate chord changes only at the beginning of a measure. Another flag indicated that the note sequence was designed to accommodate chord changes on every beat. Another flag indicated that the pattern was designed to accommodate chord changes at every half-measure. Any combination of these flags could be set for a particular pattern.

FIG. 1 illustrates a sequence style 10 that contains a plurality of patterns 11 in accordance with the prior art. Each pattern includes a designation of an embellishment type. Each pattern also indicates its intensity level—in this case either level A, level B, or level C. Finally, each pattern indicates the type of chord rhythm allowed by the pattern. An "m" flag indicates that the pattern can accommodate chord changes at the first beat of every measure. An "h" flag indicates that the pattern can accommodate chord changes at every half-measure. A "b" flag indicates that the pattern can accommodate chord changes on every beat of a measure. Although not shown, any combination of the m, h, and b flags can be set for any particular pattern.

The availability of styles, with different embellishments and intensity levels within each style, allowed an application program to determine music characteristics at a relatively high level. The application first specified a chord progression and a sequence style to a performance engine. The application then selected an embellishment type and intensity level. Typically, the intensity level would be changed dynamically in response to user stimuli. For example, a relatively higher intensity level would be selected when the user entered a dangerous portion of an interactive game.

The performance engine was responsible for selecting the proper note patterns from the sequence style specified by the application program, and for playing the note sequence of the selected pattern against the currently-selected chord progression. In order to select the proper pattern the performance engine analyzed the selected chord progression to determine the rhythm of chord changes. The performance engine then selected a note pattern whose rhythm flags indicated compatibility with the rhythm of the chord progression. If chord changes occurred only at the beginnings of measures, the performance engine would select one of the patterns whose flags indicated that it could accommodate changes at measure intervals. If chord changes occurred at half-measure intervals, the performance engine would select a pattern whose flags indicated that it could accommodate changes at half-measure intervals. If chord changes occurred at any other beats, the performance engine would select a pattern whose flags indicated that it could accommodate changes at any beat. In the case where more than one note sequence might be used with a particular chord progression, the performance engine would select one of the qualifying patterns, giving priority first to any pattern supporting changes at measure intervals, then to any pattern supporting changes at half-measure intervals, and then to any remaining pattern supporting changes at beat intervals. If more than one pattern qualified for the highest priority, the first of such patterns would be selected, or one of such patterns would be selected at random.

A system such as described above is disclosed in U.S. Pat. No. 5,753,843, entitled "System and Process for Composing Musical Sections," which issued to Microsoft Corporation on May 19, 1998. Although this system worked well, it was found to be overly restrictive in the way rhythms and intensity levels were used. One problem was the rigid definition of four different intensity levels. This was found to be too restrictive in some situations. Another problem was that the available "m", "h", and "b" flags accounted for only a limited subset of possible rhythm patterns. For example, these flags did not allow the author of a pattern to limit application of the pattern to chord progressions in which chord changes occurred on the first and last beats of a four-beat measure. The closest available option was to specify the "b" flag. However, this option would allow the pattern to be used with many different chord rhythms, such as those including beats on the first and second measures. Thus, it was difficult for a composer to control the application of patterns to particular chord patterns. Furthermore, an author could not specify a pattern that was applicable only to multi-measure patterns.

The invention described below addresses these issues, providing much greater flexibility than has previously been possible.

SUMMARY OF THE INVENTION

In accordance with the invention, a sequence style includes a plurality of note patterns. Associated with each pattern is a beat pattern that indicates the beats at which the pattern can accommodate chord changes.

In the described embodiment, the beat pattern is an array of bit flags, each corresponding to a specific beat of one or more contiguous musical measures. A bit flag is set to indicate that the note pattern can accommodate a chord change at the corresponding beat. A bit flag is cleared to indicate that the note pattern cannot accommodate a chord change at the corresponding beat.

In order to select an appropriate pattern, a performance engine examines the rhythm pattern of the currently selected chord progression, and notes the beats at which chord changes occur. It then examines the available patterns and selects one whose beat pattern most closely matches the chord rhythm.

As a further aspect of the invention, each note pattern indicates that it represents a range of intensity levels rather than a single intensity level. When specifying a desired intensity level, an application program specifies a number between 1 and 100. In response, the performance engine limits its use of note patterns to those whose intensity level ranges include the specified intensity level.

These new features provide increased flexibility and functionality in specifying and selecting note patterns. The use of beat patterns in conjunction with note patterns allows specification of arbitrary rhythms spanning one or more measures. This, in turn, allows the use of more complex chord progressions and more complex note patterns.

The use of intensity ranges allows a much greater range of intensities to be represented by different note patterns. This feature allows some sequence styles to have patterns corresponding to many different intensity levels, and other sequence styles to have relatively few patterns. In either case, the application program specifies a single desired intensity level, without any knowledge of the number of actual patterns included in a selected sequence style, and the performance engine automatically selects an appropriate pattern.

BRIEF DESCRIPTION OF THE DRAWINGS

FIG. 2 is a system diagram that illustrates an exemplary environment suitable for implementing embodiments of the present invention.

DETAILED DESCRIPTION

Computing Environment

Figure 1:
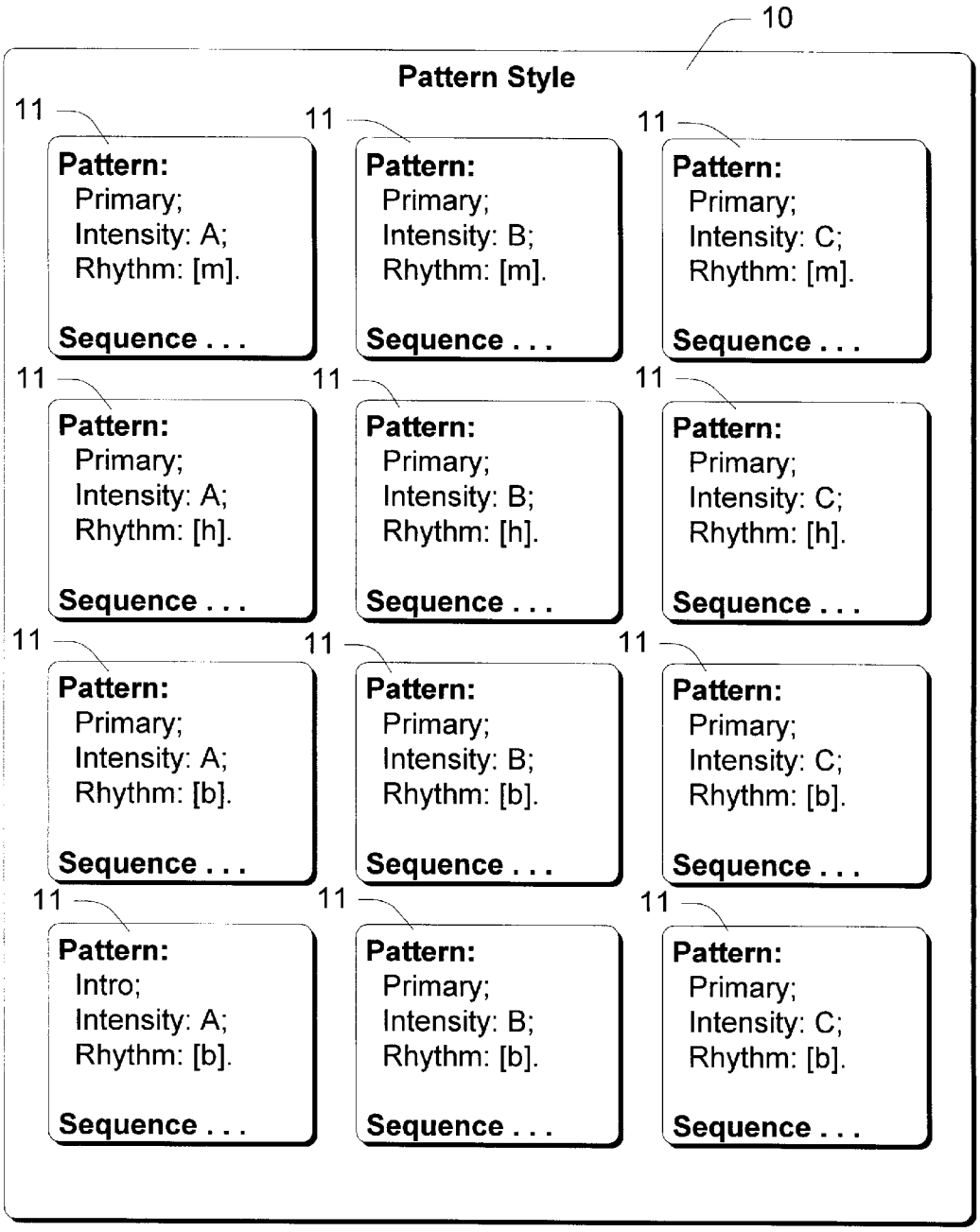
Fig. 1 Prior Art
FIG. 1 is a conceptualized view of a pattern style in accordance with the prior art.

FIG. 2 and the related discussion give a brief, general description of a suitable computing environment in which the invention may be implemented. Although not required, the invention will be described in the general context of computer-executable instructions, such as programs and program modules that are executed by a personal computer. Generally, program modules include routines, programs, objects, components, data structures, etc. that perform particular tasks or implement particular abstract data types. Moreover, those skilled in the art will appreciate that the invention may be practiced with other computer system configurations, including hand-held devices, multiprocessor systems, microprocessor-based or programmable consumer electronics, network PCs, minicomputers, mainframe computers, and the like. The invention may also be practiced in distributed computer environments where tasks are performed by remote processing devices that are linked through a communications network. In a distributed computer environment, program modules may be located in both local and remote memory storage devices.

An exemplary system for implementing the invention includes a general purpose computing device in the form of a conventional personal computer 20, including a microprocessor or other processing unit 21, a system memory 22, and a system bus 23 that couples various system components including the system memory to the processing unit 21. The system bus 23 may be any of several types of bus structures including a memory bus or memory controller, a peripheral bus, and a local bus using any of a variety of bus architectures. The system memory includes read only memory (ROM) 24 and random access memory (RAM) 25. A basic input/output system 26 (BIOS), containing the basic routines that help to transfer information between elements within personal computer 20, such as during start-up, is stored in ROM 24. The personal computer 20 further includes a hard disk drive 27 for reading from and writing to a hard disk, not shown, a magnetic disk drive 28 for reading from or writing to a removable magnetic disk 29, and an optical disk drive 30 for reading from or writing to a removable optical disk 31 such as a CD ROM or other optical media. The hard disk drive 27, magnetic disk drive 28, and optical disk drive 30 are connected to the system bus 23 by a hard disk drive interface 32, a magnetic disk drive interface 33, and an optical drive interface 34, respectively. The drives and their associated computer-readable media provide nonvolatile storage of computer readable instructions, data structures, program modules and other data for the personal computer 20. Although the exemplary environment described herein employs a hard disk, a removable magnetic disk 29 and a removable optical disk 31, it should be appreciated by those skilled in the art that other types of computer readable media which can store data that is accessible by a computer, such as magnetic cassettes, flash memory cards, digital video disks, Bernoulli cartridges, random access memories (RAMs) read only memories (ROM), and the like, may also be used in the exemplary operating environment.

RAM 25 forms executable memory, which is defined herein as physical, directly-addressable memory that a microprocessor accesses at sequential addresses to retrieve and execute instructions. This memory can also be used for storing data as programs execute.

A number of programs and/or program modules may be stored on the hard disk, magnetic disk 29 optical disk 31, ROM 24, or RAM 25, including an operating system 35, one or more application programs 36, other program objects and modules 37, and program data 38. A user may enter commands and information into the personal computer 20 through input devices such as keyboard 40 and pointing device 42. Other input devices (not shown) may include a microphone, joystick, game pad, satellite dish, scanner, or the like. These and other input devices are often connected to the processing unit 21 through a serial port interface 46 that is coupled to the system bus, but may be connected by other interfaces, such as a parallel port, game port, or a universal serial bus (USB). A monitor 47 or other type of display device is also connected to the system bus 23 via an interface, such as a video adapter 48. In addition to the monitor, personal computers typically include other peripheral output devices (not shown) such as speakers and printers.

Computer 20 includes a musical instrument digital interface ("MIDI") component 39 that provides a means for the computer to generate music in response to MIDI-formatted data. In many computers, such a MIDI component is implemented in a "sound card," which is an electronic circuit installed as an expansion board in the computer. The MIDI component responds to MIDI events by rendering appropriate tones through the speakers of the computer.

The personal computer 20 may operate in a networked environment using logical connections to one or more remote computers, such as a remote computer 49. The remote computer 49 may be another personal computer, a server, a router, a network PC, a peer device or other common network node, and typically includes many or all of the elements described above relative to the personal computer 20, although only a memory storage device 50 has been illustrated in FIG. 2. The logical connections depicted in FIG. 2 include a local area network (LAN) 51 and a wide area network (WAN) 52. Such networking environments are commonplace in offices, enterprise-wide computer networks, intranets, and the Internet.

When used in a LAN networking environment, the personal computer 20 is connected to the local network 51 through a network interface or adapter 53. When used in a WAN networking environment, the personal computer 20 typically includes a modem 54 or other means for establishing communications over the wide area network 52, such as the Internet. The modem 54, which may be internal or external, is connected to the system bus 23 via the serial port interface 46. In a networked environment, program modules depicted relative to the personal computer 20, or portions thereof, may be stored in the remote memory storage device. It will be appreciated that the network connections shown are exemplary and other means of establishing a communications link between the computers may be used.

Generally, the data processors of computer 20 are programmed by means of instructions stored at different times in the various computer-readable storage media of the computer. Programs and operating systems are typically distributed, for example, on floppy disks or CD-ROMs. From there, they are installed or loaded into the secondary memory of a computer. At execution, they are loaded at least partially into the computer's primary electronic memory. The invention described herein includes these and other various types of computer-readable storage media when such media contain instructions or programs for implementing the steps described below in conjunction with a microprocessor or other data processor. The invention also includes the computer itself when programmed according to the methods and techniques described below. Furthermore, certain sub-components of the computer may be programmed to perform the functions and steps described below. The invention includes such sub-components when they are programmed as described.

For purposes of illustration, programs and other executable program components such as the operating system are illustrated herein as discrete blocks, although it is recognized that such programs and components reside at various times in different storage components of the computer, and are executed by the data processor(s) of the computer.

The illustrated computer uses an operating system such as the "Windows" family of operating systems available from Microsoft Corporation. An operating system of this type can be configured to run on computers having various different hardware configurations, by providing appropriate software drivers for different hardware components.

Note Generation

Figure 3:
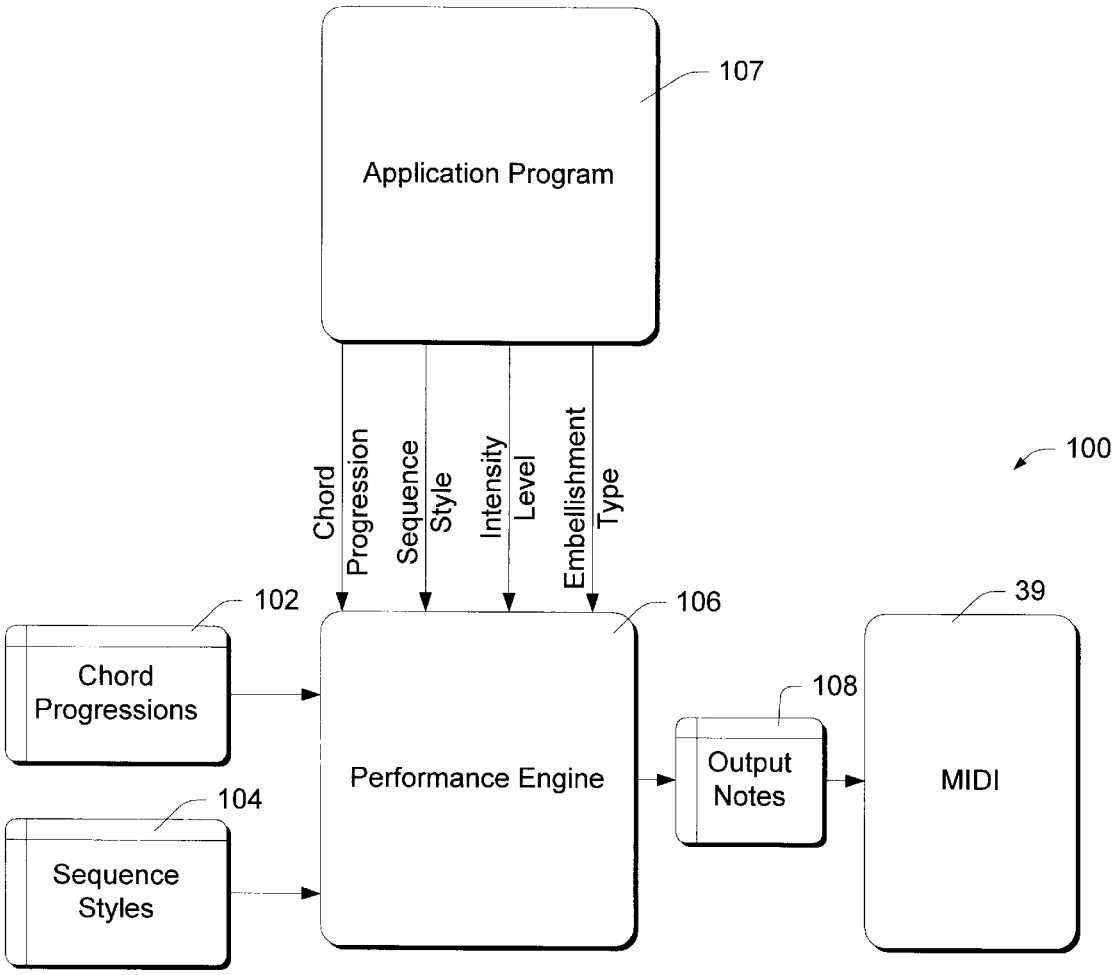
FIG. 3 is a block diagram illustrating a general architecture of a musical generating system in accordance with the invention.

FIG. 3 shows a system, implemented by the computer described above, for rendering music based on chord progressions 102 and sequence styles 104. Typically, a plurality of chord progression and sequence styles are stored in the computer's non-volatile data storage for use by various application programs. Each chord progression indicates a sequence of chords, in which chord changes are indicated as occurring at particular beats of defined measures. Instead of originating from static, disk-based files, the chord progressions might alternatively be provided as data streams from other program components, composed in real-time in response to the real-time stimuli such as operator input or changing game conditions.

Figure 4:
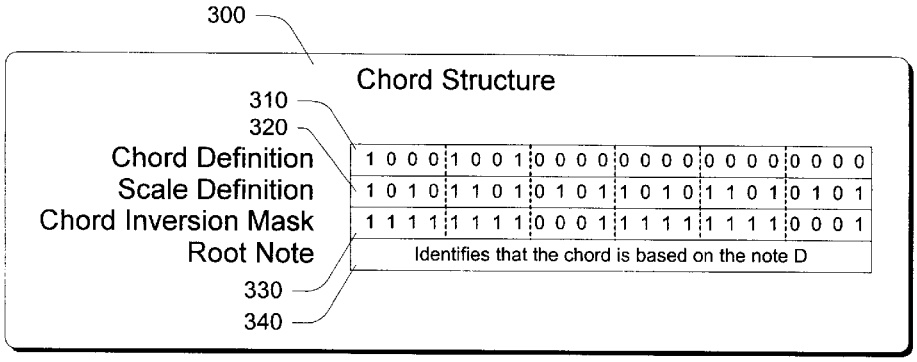
FIG. 4 is a block diagram of a chord structure.

Chord structures as shown in FIG. 4 are arranged in a data stream such as a file structure or linked list to form a chord progression. The data stream includes a sequence of data structures indicating the elements of respective chords. In addition, each data structure is accompanied by an indication of relative or absolute timing. Thus, each chord is specified as occurring at a particular measure and beat.

A chord data structure in an exemplary embodiment represents each chord with four fields: chord definition, scale definition, chord inversion mask, and root note. The first three fields are 24-bit fields with each bit representing a consecutive note in a two-octave range and with each octave including 12 semitone steps. In the chord definition field, each bit in the 24-bit field is set if the note corresponding with the bit is a member of the chord. In the scale definition field, each bit in the 24-bit field is set if the note corresponding with the bit is a member of the scale, against which the chord is defined. The chord inversion mask is used to identify notes at which inversions are allowed. Thus, in an exemplary embodiment, setting a bit in the 24-bit field indicates that inversions are allowed at that note. A desirable method of implementing inversions is described in a U.S. Patent Application filed by Microsoft Corporation concurrently herewith, entitled "Automatic Note Inversions In Sequences Having Melodic Runs," by inventors Todor C. Fay and Robert S. Williams. The root note field establishes an offset from lowest note for the chord, scale, and chord inversion mask fields. Thus, the two octave range represented by the chord, scale, and chord inversion mask fields is based on the root note field.

FIG. 4 is a block diagram illustrating an example of the data structure for a chord in the exemplary embodiment. The chord structure 300 includes a chord definition 310, a scale definition 320, a chord inversion mask 330, and a root note 340. The chord definition 310, scale definition 320, and chord inversion mask 330 are illustrated as 24-bit fields with a dashed line being drawn between each 4-bit nibble. The left-most bit of each 24-bit field represents the lowest pitch in the range of that field. The chord definition 310 illustrates the notes of a major triad. The scale definition 320 identifies a major scale. The root note 340 indicates that the chord is based on the note D. The chord inversion mask indicates that inversions are allowed except between the 5th and 7th of the chord.

Figure 5:
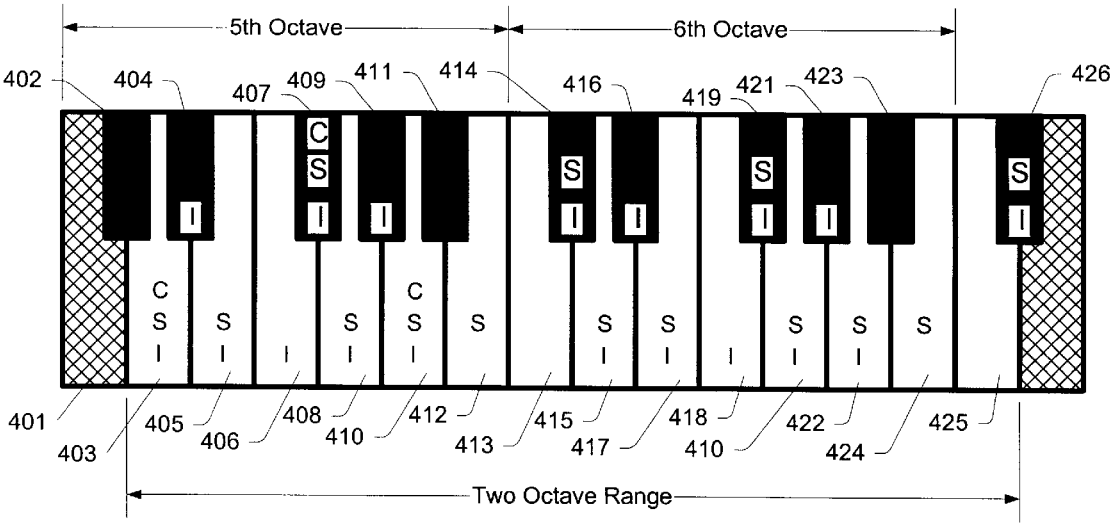
FIG. 5 is a diagram of a portion of a keyboard, indicating the chord specified by the structure of FIG. 4.

FIG. 5 is a diagram of the pertinent portion of a keyboard relative to the example chord structure 300 in FIG. 4. The keyboard keys 401–412 represent the notes of the 5th octave and the keyboard keys 413–424 represent the notes of the 6th octave. Key 403 corresponds with the D note in the 5th octave (i.e., root note 340 of FIG. 4). When the chord definition 310 is offset by the root note 340, the notes correspond with keyboard keys 403, 407, and 410. These keys are further identified in FIG. 5 by the character 'C'. Similarly, the scale definition 320 offset by the root note 340 correspond with the keyboard keys 403, 405, 407, 408, 410, 412, 414, 415, 417, 419, 420, 422, 424, and 426. These keys are further identified in FIG. 5 by the character 'S'. Finally, the chord inversion mask 330 offset by the root note 340 corresponds with the keyboard keys 403, 404, 405, 406, 407, 408, 409, 410, 414, 415, 416, 417, 418, 419, 420, 421, 422, and 426. These keys are further identified in FIG. 5 by the character 'I'.

A note sequence is similarly represented as a stream of data structures, accompanied by timing specifications. In this case, each data structure corresponds to an individual note. Each note in a note sequence is specified relative to a chord against which the note is to be interpreted. As described above, a chord is defined by a chord structure that includes note of the chord and notes of an underlying scale. A note in the note sequence is specified by four items (relative to the current chord and chord scale of the chord progression): a chord octave position, indicating one of twelve MIDI octaves within which note will reside; a note within the chord (such as the $n^{th}$ note of the chord); an offset along the chord scale from the specified note of the chord; and an additional absolute offset to allow for accidentals. At rendering time, these four items are evaluated against the corresponding current chord structure to produce an output note.

Referring again to FIG. 3, a performance engine 106 receives directions and instructions from an application program 107. Specifically, the performance engine receives designations or selections of a chord progression, a sequence style, an intensity or playback level, and an embellishment type. The designated chord progression and sequence style (referred to below as the selected or current chord progression and sequence style) are selected from chord progressions 102 and sequence styles 104.

In response to the selections from application program 107, the performance engine selects an appropriate note pattern from the current sequence style and plays the note pattern against the current or corresponding chord progression to generate output notes 108. In the described embodiment, the output note sequence is formatted as a MIDI stream, and is provided to a MIDI controller or interface 39. The MIDI controller or interface interprets the MIDI stream and in response generates appropriate musical tones on the speakers of computer 20. Alternatively, the MIDI controller or interface 39 might communicate the MIDI stream to an external MIDI device (such as a keyboard or synthesizer) for rendering by the external MIDI device.

Pattern Styles

Figure 6:
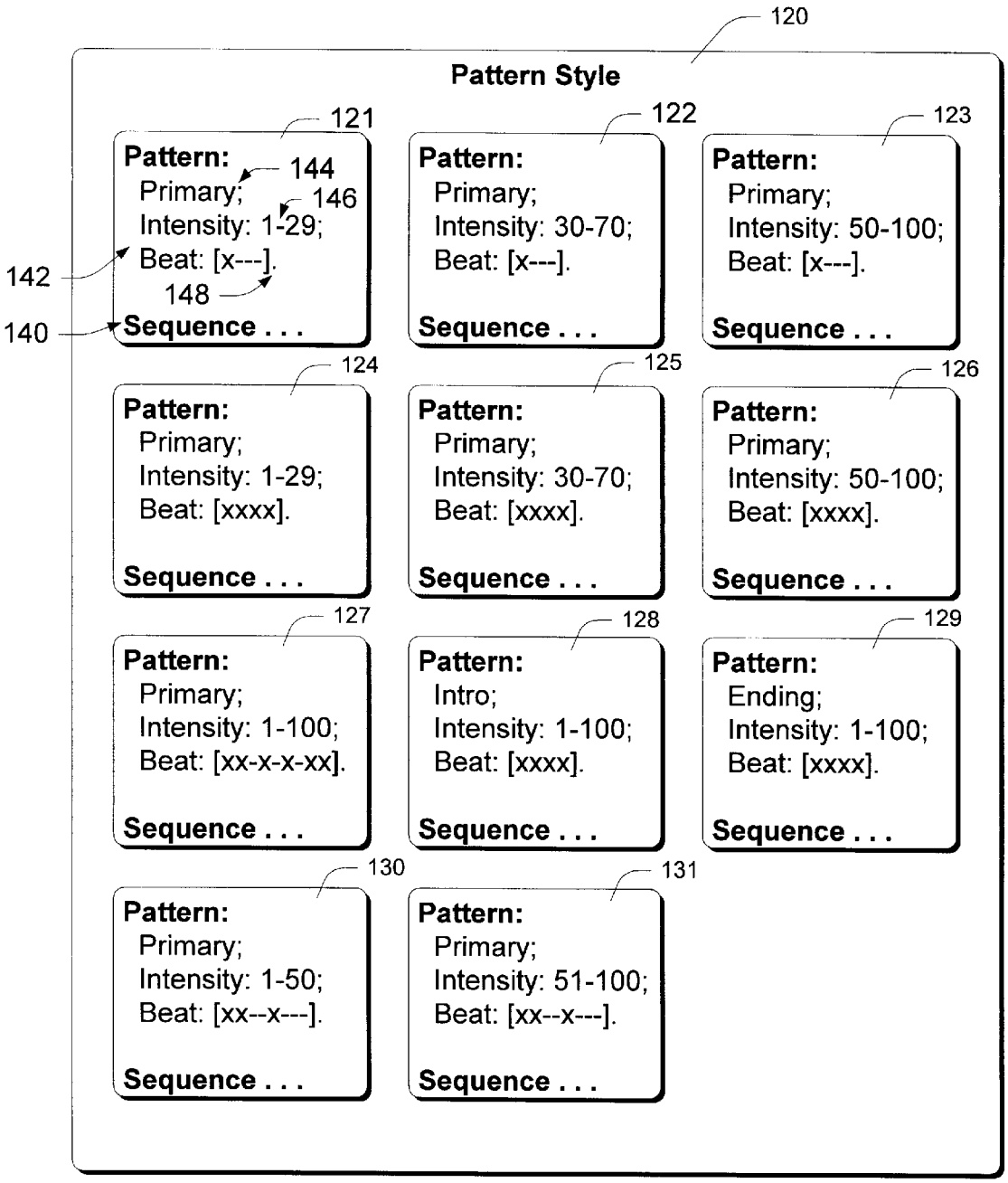
FIG. 6 is a conceptualized view of a pattern style in accordance with an embodiment of the invention.

FIG. 6 shows a pattern style 120 in accordance with the described embodiment of the invention. The pattern style includes a plurality of note patterns 121–131. Each pattern comprises a note sequence 140 and associated parameters 142. Parameters 142 include a designation 144 of an embellishment type, such as "intro," "primary," or "ending." The parameters also include a range 146 of playback levels, which correspond to intensity levels in the described embodiment of the invention. Each range is a subset of an overall range of 1–100. In addition, each pattern includes a beat pattern 148, associated with the pattern's note sequence, that indicates the beats at which the note sequence can accommodate chord changes.

A beat pattern in the described embodiment of the invention is a sequence of flags corresponding respectively to every beat of a contiguous set of beats, or to every beat of one or more contiguous measures. If a flag is set, the note sequence is able to accommodate a chord change at the corresponding beat. If the flag is not set, the note sequence does not allow or accommodate a chord change at the corresponding beat. In practice, a beat pattern is implemented as an array of 32-bit integers, each corresponding to a measure. This allows up to 32 beats per measure. The number of measures in the note sequence of a particular pattern determines the number of 32-bit integers in the pattern's beat pattern array.

The combination of beat patterns and intensity level ranges allows tremendous flexibility, as is illustrated in FIG. 6. In the first illustrated row of patterns in FIG. 6, there are three patterns of the "primary" embellishment type. These patterns have different intensity level ranges, but all support the same beat pattern of [x---]. This nomenclature indicates set flags by "x", and cleared flags is by "-". Thus, this beat pattern indicates that the associated note sequence can support a chord change on the first of four beats, and that chord changes are not allowed on the following three beats of the four-beat pattern. Pattern 121 supports an intensity level range of 1–29. Pattern 122 supports an intensity level range of 30–70. Pattern 123 supports an intensity level range of 50–100. Note that the latter two intensity ranges overlap each other, raising the possibility that both of the corresponding patterns might qualify for selection-such as when, for example, an intensity level of 60 is specified. In the case of ties such as this, the performance engine chooses randomly between the two (or more) qualifying patterns.

The second row of FIG. 6 (patterns 124–126) illustrates another three primary patterns, having the same intensity level ranges as the first row. In the second row, however, each of the patterns supports a [xxxx] beat pattern. This indicates that these patterns allow chord changes on any beats.

Pattern 127 is a somewhat more complex pattern that accommodates a more complex chord rhythm: [xx-x-x-xx]. This pattern thus allows chord changes on the first, second, fourth, sixth, eighth, and ninth beats of a nine-beat sequence. Chord changes are not allowed at the third, fifth, and seventh beats. Only one pattern supporting this beat pattern is provided in style 120. However, it specifies an intensity level range of 1–100, and therefore qualifies for any specified intensity level.

Pattern 128 is an "intro" pattern. Only one intro pattern is provided in this example, and it supports an intensity level range of 1–100. In addition, its beat pattern [xxxx] allows chord changes on any beat. Pattern 129 is similar, being of the "ending" embellishment type.

Patterns 130 and 131 are two additional primary patterns, supporting a somewhat complex beat pattern of [xx--x---]. These patterns are identical except that they designate two mutually exclusive intensity level ranges: 1–50 and 51–100.

The patterns shown in FIG. 6 are examples of a potentially limitless number of combinations of embellishment types, intensity ranges, and beat patterns that can form a pattern style.

Selecting a Note Sequence

Figure 7:
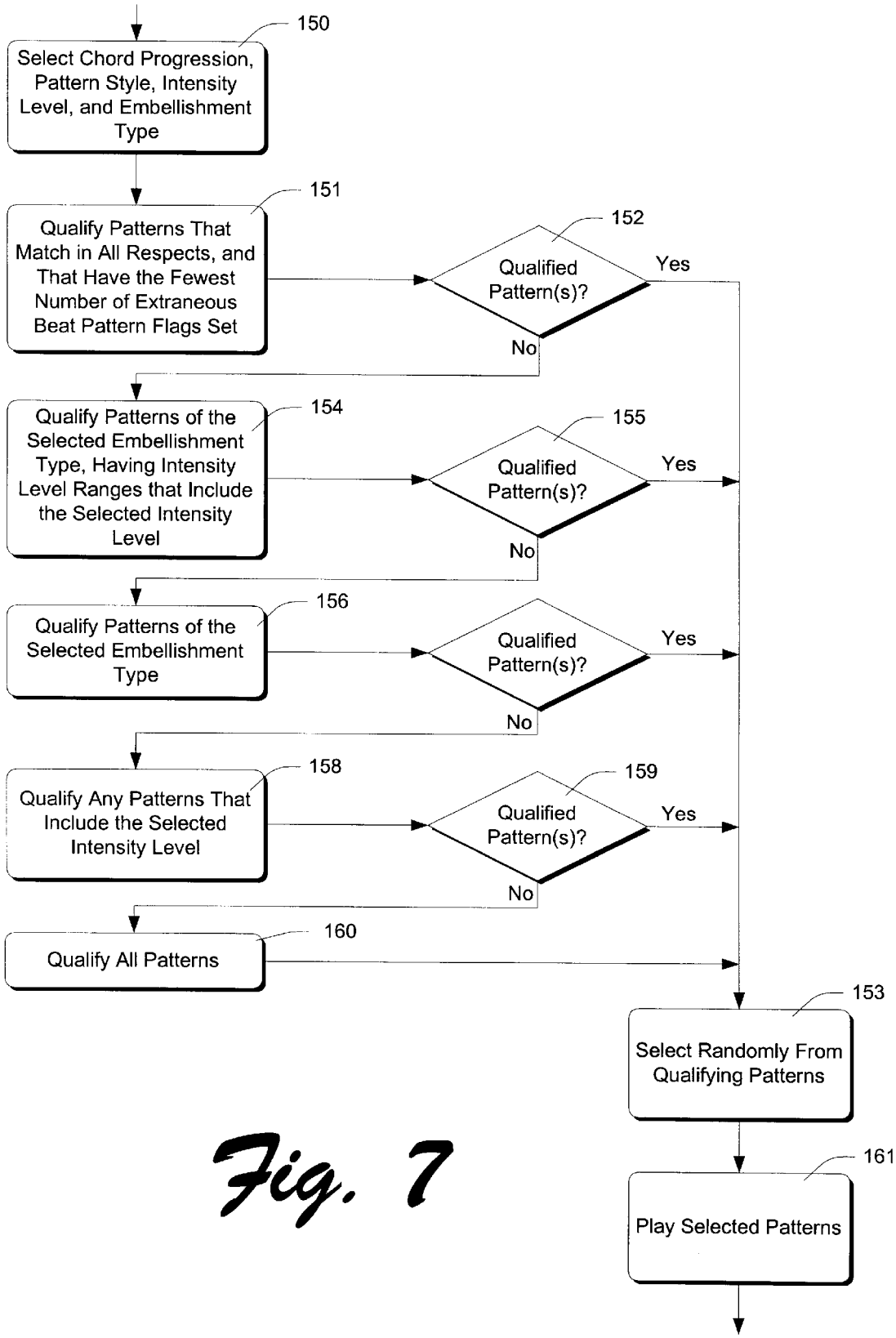
FIG. 7 is a flowchart illustrating methodological aspects of the invention.

FIG. 7 shows steps performed in determining an appropriate one of the patterns for playback at a particular time. A step 150 comprises selecting the current chord progression, the current pattern style, the desired embellishment type, and the desired playback or intensity level. This step is normally performed in response to instructions from an application program. The playback level is specified as a single number, in the range of 1–100.

Steps 151–160 are performed to select a specific one of the selected style's patterns for playback. Generally, these steps comprise a process of determining a set of one or more note patterns (and their note sequences) that qualify under different matching conditions. The algorithm first attempts to find or qualify closely matching note patterns, and then falls back to less restrictive matching conditions if necessary to find a matching note pattern. A step 151 imposes the most stringent matching conditions for qualification. In this step, the performance engine identifies a set of qualifying note patterns that meet three conditions: (a) the note pattern is of the embellishment type specified in step 150; (b) the note pattern has a beat pattern with set flags corresponding to those beats at which the current chord progression indicates chord changes; and (c) the note pattern has a playback level range that includes the intensity level specified in step 150. Step 150 further involves determining the length of the longest of these patterns, and limiting the qualifying set to patterns of that length. From these patterns, the pattern having the fewest number of set bits is identified, and the qualifying set is further limited to those patterns having only this number of set bits. Thus, the note patterns whose beat patterns most closely match the chord progression pattern are preferred over note patterns whose beat patterns have extraneous set flags.

Step 152 determines whether any note patterns were qualified in step 151. If they were, step 153 is executed of selecting one of the note patterns randomly from those patterns qualified in step 151. Otherwise, a less restrictive qualifying step 154 is performed.

Step 154 comprises qualifying any note pattern that meets the following two conditions: (a) the note pattern is of the embellishment type specified in step 150; and (b) the note pattern has a playback level range that includes the playback level specified in step 150. Thus, no attempt is made to match beat patterns to chord rhythms in step 154. Step 155 determines whether any note patterns were qualified in step 154. If they were, step 153 is executed of selecting one of the note patterns randomly from those patterns qualified in step 154. Otherwise, a less restrictive qualifying step 156 is performed.

Step 156 comprises qualifying any note pattern that is of the embellishment type specified in step 150. Both playback levels and beat patterns are ignored for purposes of this step. Step 157 determines whether any note patterns were qualified in step 156. If they were, step 153 is executed of selecting one of the note patterns randomly from those patterns qualified in step 156. Otherwise, a less restrictive qualifying step 158 is performed.

Step 158 comprises qualifying any note pattern whose playback level range includes the playback level specified in step 150. Both embellishment types and beat patterns ignored for purposes of this step. Step 159 determines whether any note patterns were qualified in step 158. If they were, step 153 is executed of selecting one of the note patterns randomly from those patterns qualified in step 158. Otherwise, a less restrictive qualifying step 160 is performed.

Qualifying step 160 comprises qualifying all note pattern of the pattern style. Step 153 is then executed of selecting one of the note patterns randomly from these patterns.

Step 161 comprises playing the note sequence of the selected note pattern against its corresponding chord progression.

As an optional enhancement, a desired range of intensity levels can be specified in step 150, to potentially increase the number of qualifying note patterns. In accordance with this option, any given note pattern qualifies under the steps above only if its playback level range intersects with the desired range of playback levels. By specifying a relatively large intensity range, a particular musical segment can be made to exhibit random variations from one performance to another.

Conclusion

The invention provides a significant improvement in the way different patterns are selected from pattern styles. By specifying a beat pattern in the way described above, a note sequence can be tailored for complex, multi-measure chord progressions, and its use can be limited to chord progressions having a particular chord rhythm. The use of intensity level ranges within patterns of a style provides great flexibility in designing a style, in that the composer is not constrained to a predetermined number of intensity levels.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. A method of generating music notes, comprising the following steps:

reading a chord progression indicating chord changes at particular beats;

reading a sequence style that includes a plurality of note patterns for playing against chord progressions, wherein the note patterns have corresponding beat patterns with flags corresponding respectively to every beat of one or more contiguous measures, and wherein a particular note pattern can accommodate chord changes only at beats corresponding to set flags of its beat pattern;

selecting one of the note patterns whose beat pattern has set flags corresponding to those beats at which the chord progression indicates chord changes;

playing the selected note pattern against the chord progression.

2. A method as recited in claim 1, wherein the selecting step includes selecting said one of the note patterns whose beat pattern has the fewest set flags while still having set flags corresponding to those beats at which the chord progression indicates chord changes.

3. A method as recited in claim 1, wherein the beat patterns comprise bit arrays.

4. A computer program stored on one or more computer-readable storage media for generating music notes, the program comprising the following steps:

selecting a chord progression, the chord progression indicating chord changes at particular beats;

selecting a sequence style, the sequence style comprising a plurality note patterns for playing against chord progressions, each note pattern being associated with a pre-determined range of playback levels;

selecting a desired playback level for sequence style playback;

the note patterns having corresponding beat patterns, wherein a beat pattern corresponding to a note pattern indicates beats at which the note pattern can accommodate chord changes;

selecting one of the note patterns of the sequence style for playback against the selected chord progression, said one of the note patterns being selected from one or more qualifying note patterns of the sequence style, wherein a qualifying note pattern has (a) a beat pattern that indicates at least those beats at which the chord progression indicates chord changes and (b) a playback level range that includes the desired playback level;

playing said one of the note patterns against the designated chord progression.

5. A computer program as recited in claim 4, comprising a further step of selecting a desired range of playback levels around the desired playback level, wherein a given note pattern is a qualifying note pattern only if its playback level range intersects with the desired range of playback levels.

6. A computer program as recited in claim 4, wherein the step of selecting one of the note patterns comprises selecting the qualifying note pattern that indicates the fewest beats at which it can accommodate chord changes.

7. A computer program as recited in claim 4, wherein an individual beat pattern indicates beats of multiple contiguous measures upon which the corresponding note pattern can accommodate chord changes.

8. A computer program as recited in claim 4, wherein an individual beat pattern comprises flags corresponding respectively to every beat of one or more contiguous measures, and wherein a particular note pattern can accommodate chord changes only at beats corresponding to set flags of its beat pattern.

9. A computer program as recited in claim 4, wherein the beat patterns are specified in bit arrays, the bits of each array corresponding respectively to every beat of one or more contiguous measures.

10. A method of generating music notes, comprising the following steps:

selecting a sequence style comprising a plurality note patterns, each note pattern being associated with a pre-determined range of playback levels;

accepting a desired playback level for sequence style playback;

selecting one of the note patterns whose range of playback levels includes the desired playback level;

playing the selected one of the note patterns.

11. A method as recited in claim 10, wherein the playback level ranges of the note patterns are numerical ranges.

12. A method as recited in claim 10, comprising a further step of selecting a chord progression, the playing step comprising playing the selected one of the note patterns against the selected chord progression.

13. A method as recited in claim 10, further comprising:

selecting a chord progression, the chord progression indicating chord changes at particular beats;

indicating beat patterns for respective note patterns, wherein a beat pattern corresponding to a note pattern indicates beats at which the note pattern can accommodate chord changes;

wherein the step of selecting one of the note patterns comprises selecting said one of the note patterns from those note patterns having beat patterns that indicate at least those beats at which the chord progression indicates chord changes;

playing the selected one of the note patterns against the selected chord progression.

14. A method as recited in claim 13, wherein the step of selecting one of the note patterns includes selecting said one of the note patterns whose beat pattern indicates the fewest beats while still indicating those beats at which the chord progression indicates chord changes.

15. A method as recited in claim 13, wherein beat patterns indicate beats of multiple contiguous measures upon which the note patterns can accommodate chord changes.

16. A method as recited in claim 13, wherein an individual beat pattern contains a beat indication corresponding to every beat of one or more contiguous measures, the beat indication for a particular beat indicating whether the corresponding note pattern can accommodate a chord change at that beat.

17. A method as recited in claim 13, wherein an individual beat pattern comprises flags corresponding respectively to every beat of one or more contiguous measures, and wherein a particular note pattern can accommodate chord changes only at beats corresponding to set flags of its beat pattern.

18. A method as recited in claim 13, wherein the beat patterns are specified in bit arrays, the bits of each array corresponding to respective beats of one or more contiguous measures.

19. A computer comprising:

a data storage medium;

a plurality of chord progressions stored on the data storage medium, the chord progressions indicating chord changes at particular beats;

a plurality of sequence styles stored on the data storage medium, each sequence style comprising a plurality of note patterns for playing against the chord progressions, each note pattern being associated with a pre-determined range of playback levels;

wherein the note patterns have corresponding beat patterns with flags corresponding respectively to every beat of one or more contiguous measures, and wherein a particular note pattern can accommodate chord changes only at beats corresponding to set flags of its beat pattern;

a data processor programmed to perform steps comprising:

selecting a chord progression and a pattern style for playback;

accepting a desired playback level for pattern style playback;

selecting one of the note patterns of the sequence style for playback against the selected chord progression, said one of the note patterns being selected from one or more qualifying note patterns of the sequence style, wherein a qualifying note pattern has (a) a beat pattern with set flags corresponding to those beats at which the chord progression indicates chord changes and (b) a playback level range that includes the desired playback level;

playing the selected one of the note patterns against the selected chord progression.

20. A computer as recited in claim 19, wherein the step of selecting one of the note patterns comprises selecting the qualifying note pattern that has the fewest set flags.

21. A computer as recited in claim 19, wherein the beat patterns are specified in bit arrays.

22. A computer as recited in claim 19, wherein the playback level ranges of the note patterns are numerical ranges.

* * * * *